US008573505B1

(12) United States Patent
Hennessy

(10) Patent No.: US 8,573,505 B1
(45) Date of Patent: Nov. 5, 2013

(54) THAWING SYSTEM FOR MACHINERY UNDERCARRIAGES

(76) Inventor: Dana A. Hennessy, Warren, PA (US)

( * ) Notice: Subject to any disclaimer, the term of this patent is extended or adjusted under 35 U.S.C. 154(b) by 743 days.

(21) Appl. No.: 12/752,862

(22) Filed: Apr. 1, 2010

(51) Int. Cl.
*B60H 1/14* (2006.01)

(52) U.S. Cl.
USPC ..... 237/12.3 R; 432/9; 180/9.1; 237/28; 237/12.4

(58) Field of Classification Search
USPC ..... 432/9; 237/12.3 B, 12.3 R, 12.4, 1 R, 5, 237/28; 180/9.1
See application file for complete search history.

(56) References Cited

U.S. PATENT DOCUMENTS

| | | | | |
|---|---|---|---|---|
| 3,930,549 | A * | 1/1976 | Griffith | 180/9.48 |
| 4,030,623 | A * | 6/1977 | Bridwell et al. | 414/694 |
| 4,222,581 | A * | 9/1980 | Treadwell et al. | 280/81.1 |
| 4,324,307 | A | 4/1982 | Schittino et al. | |
| D274,621 | S | 7/1984 | Takamatsu et al. | |
| 4,848,510 | A | 7/1989 | Ahmed | |
| 6,021,843 | A | 2/2000 | Roach | |
| 6,354,678 | B1 * | 3/2002 | Oertley | 305/144 |
| 6,416,370 | B1 * | 7/2002 | Bland et al. | 440/61 R |
| 6,539,711 | B1 * | 4/2003 | Raychinov | 60/413 |
| 6,695,743 | B2 * | 2/2004 | Tanaka et al. | 477/98 |
| 6,848,726 | B1 | 2/2005 | Horsham | |
| 6,946,621 | B1 | 9/2005 | Roseman | |
| 7,520,475 | B2 * | 4/2009 | Opperthauser | 248/71 |
| 7,854,284 | B2 * | 12/2010 | Wada et al. | 180/89.13 |
| 8,186,156 | B2 * | 5/2012 | Kamiya et al. | 60/420 |
| 2011/0061873 | A1 * | 3/2011 | Patterson et al. | 166/369 |
| 2011/0196585 | A1 * | 8/2011 | Ishibashi et al. | 701/51 |
| 2012/0003069 | A1 * | 1/2012 | Hagiwara et al. | 414/685 |

* cited by examiner

*Primary Examiner* — Steven B McAllister
*Assistant Examiner* — Ko-Wei Lin
(74) *Attorney, Agent, or Firm* — MacDonald, Illig, Jones & Britton LLP

(57) ABSTRACT

A method of heating an undercarriage of a machine featuring obtaining a thawing system with a hydraulic system functioning to heat hydraulic fluid and a first high pressure line and a second high pressure line each fluidly connected to the hydraulic system and each adapted to carry hydraulic fluid from the hydraulic system; operatively connecting the hydraulic system to a main engine of the machine; creating channels in the machine to allow passage of the first high pressure line and the second high pressure line from the hydraulic system to the undercarriage of the machine; and activating the system, wherein when the system is activated the hydraulic fluid is delivered to the undercarriage providing heat to the undercarriage for thawing purposes.

7 Claims, 3 Drawing Sheets

THAWING SYSTEM FOR MACHINERY UNDERCARRIAGES

FIELD OF THE INVENTION

The present invention is directed to a system for heating and thawing undercarriages of large machinery such as bulldozers and excavators.

BACKGROUND OF THE INVENTION

It can take about 30 to 90 minutes per workday for an operator to properly clean the undercarriage of a machine (such as a bulldozer or excavator) to prevent freeze ups. In some cases, operators can use propane track torches to thaw frozen undercarriages. The present invention features a thawing system for automatically thawing frozen undercarriages with the use of heat from the existing machine (e.g., bulldozer, excavator).

Without wishing to limit the present invention to any theory or mechanism, it is believed that the thawing system of the present invention is advantageous because it can help minimize operator time spent on maintenance as well as cut down on the need to replace parts of the undercarriage due to freezes. The system of the present invention is easy and safe to use, saves time, and helps to protect equipment. For example, instead of workers struggling to chip mud from track frames and replace ruined parts, this system provides warmth to the undercarriage with hydraulic fluid tubing, water, hydrostatics, or electricity. This warms key components, preventing snow and ice accumulation, as well as mud buildup. The system of the present invention is also adaptable to different types of running track-style heavy equipment.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-5, the present invention features a thawing system 100 for thawing the frozen undercarriage of a machine 101 (e.g., bulldozer, excavator). The thawing may be achieved with the use of heat from the existing machine 101.

Figure 1:
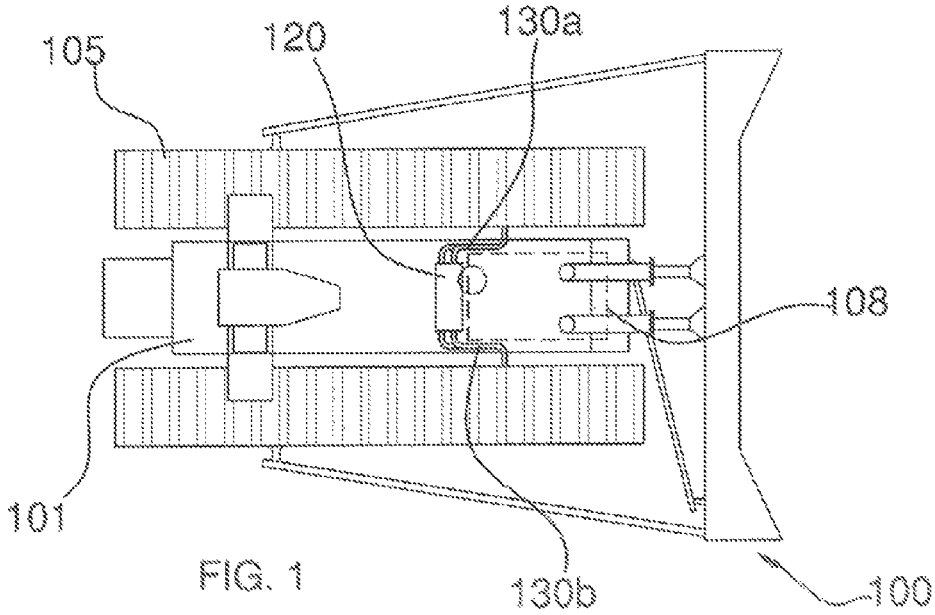
FIG. 1 is a top view of a thawing system of the present invention.
Figure 3:
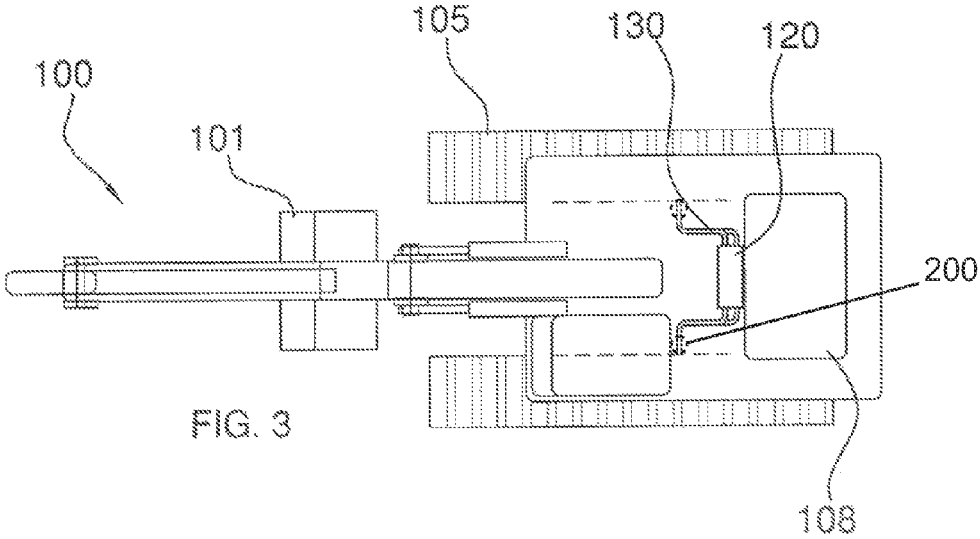
FIG. 3 is a top view of a thawing system of the present invention.

Referring now to FIG. 1 and FIG. 3, the thawing system 100 comprises a hydraulic system 120 (e.g., hydraulic pump) positioned next to or near the main engine 108 of the machine 101. Hydraulic pumps are well known to one of ordinary skill in the art. A first line 130*a* and a second line 130*b* (e.g., high pressure lines) are each fluidly connected to the hydraulic system 120 and are adapted to carry hydraulic fluid into the undercarriage. The heat from the hydraulic fluid helps heat up the undercarriage, thereby thawing it or helping to prevent it from freezing.

Figure 5:
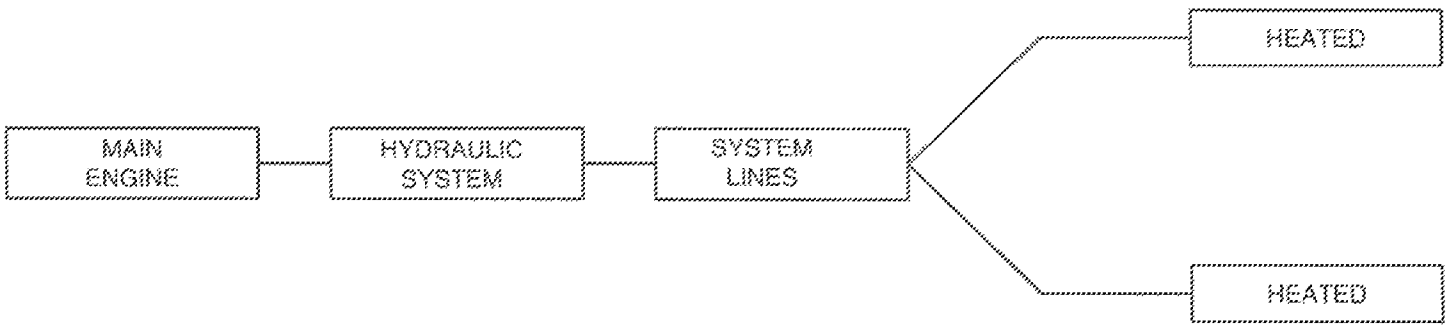
FIG. 5 is a schematic representation of the components of the thawing system of the present invention.

Referring now to FIG. 5, the hydraulic system 120 is operatively connected to the main engine 108 of the machine 101. The lines 130 ("system lines") are operatively (and fluidly) connected to the hydraulic system 120. The lines 130 provide heat to the undercarriage of the machine 101.

Channels 200 can be formed in the machine 101 (e.g., the track frame) via known mechanisms of machining the metal. The lines 130 travel through the channels 200 to reach the undercarriage of the machine 101. The lines 130 used to transfer the fluid from the hydraulic system 120 to the undercarriage may be constructed from a variety of materials, including but not limited to metal tubing such as aluminum or stainless steel.

Figure 2:
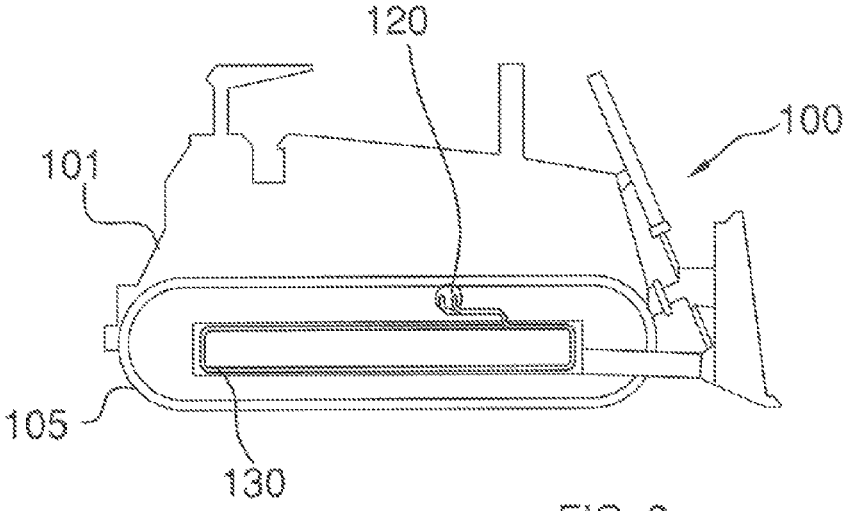
FIG. 2 is a side view of the thawing system of FIG. 1.
Figure 4:
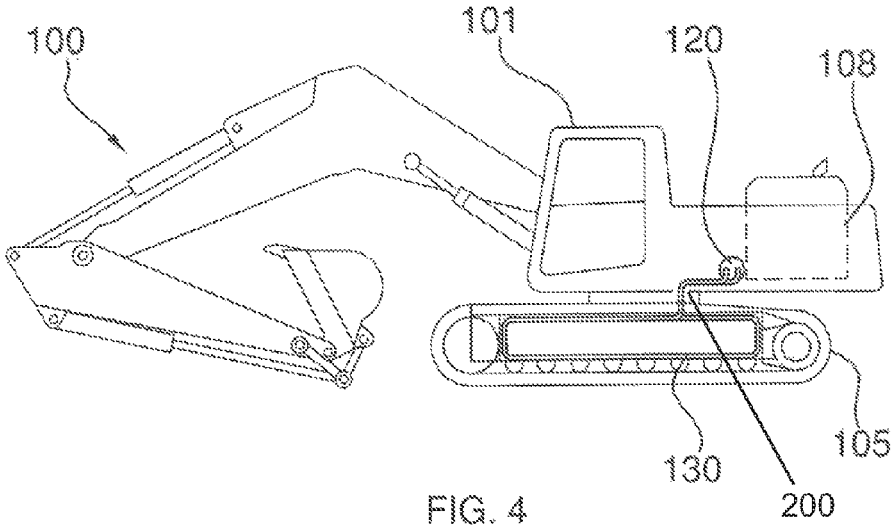
FIG. 4 is a side view of the thawing system of FIG. 3.

As shown in FIG. 2 and FIG. 4, in some embodiments, the lines 130 are positioned in a molded track frame traveling the perimeter of the track frame 105. Heat from the hydraulic fluid may heat the front idler, top and bottom rollers, and metal shields.

The present invention also features methods of heating undercarriages of such machines 101. The method comprises obtaining the system 100 of the present invention. The method further comprises creating channels in the machine 101 to allow passage of the lines 130 and installing a hydraulic system 120, wherein the hydraulic system 120 is operatively connected to the main engine of the machine 101 and to the lines 130. When the system 100 is activated, the lines provide heat (via the hydraulic system 120) to the undercarriage of the machine 101.

The following the disclosures of the following U.S. Patents are incorporated in their entirety by reference herein: U.S. Pat. No. 6,946,621; U.S. Pat. No. 6,848,726; U.S. Pat. No. 6,021,843; U.S. Pat. No. 4,848,510; U.S. Pat. No. 4,324,307.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A method of heating an undercarriage of a machine, said method comprising:

(a) obtaining a thawing system comprising:

(i) a hydraulic system having a pump; and (ii) a first high pressure line and a second high pressure line each fluidly connected to the hydraulic system and each adapted to carry hydraulic fluid from the hydraulic system;

(b) operatively connecting the hydraulic system to a main engine of the machine;

(c) creating channels in the machine to allow passage of the first high pressure line and the second high pressure line from the hydraulic system to the undercarriage of the machine;

(d) laying the first high pressure line and second high pressure lines in a molded track frame traveling the perimeter of the track frame, wherein the lines provide heat to heat a front idler, a top roller, a bottom roller, and a metal shield; and (e) activating the system, wherein when the system is activated the hydraulic fluid is delivered to the undercarriage providing heat to the undercarriage for thawing purposes.

2. The method of claim 1, wherein the machine is a bulldozer or an excavator.

3. The method of claim 1, wherein the first high pressure line or the second high pressure line is constructed from an aluminum or a stainless steel.

4. A thawing system an undercarriage of a machine, said system comprising:

(a) (currently amended) a hydraulic system having a pump for operatively connecting to a main engine of the machine, the hydraulic system functions to pump hydraulic fluid; and (b) a first high pressure line and a second high pressure line each fluidly connected to the hydraulic system and each adapted to carry hydraulic fluid from the hydraulic system, the first high pressure line and second high pressure line each travel from the hydraulic system to the undercarriage of the machine via, channels formed in the machine, the first high pressure line and second high pressure lines are disposed in a molded track frame traveling the perimeter of the track frame, wherein the lines provide heat to heat a front idler, a top roller, a bottom roller, and a metal shield, wherein when the system is activated the hydraulic fluid is delivered to the undercarriage providing heat to the undercarriage for thawing purposes.

5. The system of claim 4, wherein the machine is a bulldozer or an excavator.

6. The system of claim 4, wherein the first high pressure line or the second high pressure line is constructed from an aluminum or a stainless steel.

7. A thawing system an undercarriage of a machine, said system consisting of:

(a) a hydraulic system having a pump for operatively connecting to a main engine of the machine, the hydraulic system functions to pump hydraulic fluid; and (b) a first high pressure line and a second high pressure line each fluidly connected to the hydraulic system and each adapted to carry hydraulic fluid from the hydraulic system, the first high pressure line and second high pressure line each travel from the hydraulic system to the undercarriage of the machine via channels formed in the machine, the first high pressure line and the second high pressure line are disposed in a molded track frame traveling the perimeter of the track frame, wherein the lines provide heat to heat a front idler, a top roller, a bottom roller, and a metal shield, wherein when the system is activated the hydraulic fluid is delivered to the undercarriage providing heat to the undercarriage for thawing purposes.

* * * * *